US006645325B1

(12) United States Patent
Nickel

(10) Patent No.: US 6,645,325 B1
(45) **Date of Patent: *Nov. 11, 2003**

(54) FAST-BURNING NITROCELLULOSE COMPOSITIONS

(76) Inventor: Russell R. Nickel, 736 E. 1st Ave. North, Columbus, MT (US) 59019

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/088,359

(22) Filed: Jun. 1, 1998

(51) Int. Cl.[7] ..... C06B 45/10

(52) U.S. Cl. ..... 149/19.8; 149/36; 149/96; 149/97; 149/98; 149/100

(58) Field of Search ..... 149/19.8, 36, 96–98, 149/100

(56) References Cited

U.S. PATENT DOCUMENTS

| | | | | | |
|---|---|---|---|---|---|
| 3,244,702 | A | | 4/1966 | Marcus | |
| 3,719,604 | A | * | 3/1973 | Prior et al. | 149/19.8 |
| 3,797,238 | A | * | 3/1974 | Iwanciow et al. | 60/219 |
| 3,865,659 | A | * | 2/1975 | Flynn et al. | 149/19.8 |
| 3,897,733 | A | * | 8/1975 | Stiefel et al. | 149/19.8 |
| 3,923,564 | A | * | 12/1975 | Lantz | 149/19.8 |
| 3,940,298 | A | * | 2/1976 | Beckert et al. | 568/944 |
| 4,002,514 | A | * | 1/1977 | Plomer et al. | 149/19.4 |
| 4,023,996 | A | * | 5/1977 | Leneveu | 149/19.8 |
| 4,072,546 | A | * | 2/1978 | Winer | 149/19.8 |
| 4,078,954 | A | * | 3/1978 | Bernardy | 149/19.8 |
| 4,180,424 | A | * | 12/1979 | Reed, Jr. et al. | 149/19.4 |
| 4,186,068 | A | * | 1/1980 | Rubens | 521/50.5 |
| 4,358,327 | A | * | 11/1982 | Reed, Jr. et al. | 149/19.4 |
| 4,408,534 | A | * | 10/1983 | Araki et al. | 149/19.8 |
| 4,662,451 | A | * | 5/1987 | Boade | 166/299 |
| 4,681,643 | A | * | 7/1987 | Colgate et al. | 149/96 |
| 5,053,088 | A | * | 10/1991 | Sayles | 149/21 |
| 5,092,945 | A | * | 3/1992 | Reed et al. | 149/19.4 |
| 5,125,684 | A | * | 6/1992 | Cartwright | 149/19.8 |
| 5,295,545 | A | | 3/1994 | Passamaneck | 166/299 |
| 5,872,329 | A | * | 2/1999 | Burns et al. | 149/36 |
| 5,917,146 | A | * | 6/1999 | Hiskey et al. | 149/36 |
| 6,033,748 | A | * | 3/2000 | Dunning et al. | 428/36.5 |

OTHER PUBLICATIONS

Chavez, David E.; Hiskey, Michael A. "High–Nitrogen Pyrotechnic Compositions", *Journal of Pyrotechnics*, vol. 7 pp. 11–14, (Summer 1998).

Coburn, M.D.; Hiskey, M. A.; Lee, K.Y; Ott, D.G.; and Stinecipher, M.M "Oxidation of 3,6–Diamino–1,2,4,5–tetrazine and 3,6–Bis(S,S–dimethylsulfilimino)–1,2,4,5–tetrazine", *Journal of Heterocyclic Chemistry*, vol. 30, pp. 1593–1595, (Dec. 1993).

* cited by examiner

*Primary Examiner*—Edward A. Miller
(74) *Attorney, Agent, or Firm*—James K. Poole, Esq.

(57) ABSTRACT

Explosive or propellant compositions containing at least one nitrocellulose contain an additive including at least one substituted tetrazine in amounts effective to increase the burning rate of the composition. A preferred additive is 3,6-dihydrazino-s-tetrazine.

14 Claims, No Drawings

FAST-BURNING NITROCELLULOSE COMPOSITIONS

FIELD OF INVENTION

The present invention is related to fast-burning nitrocellulose compositions comprising as additives substituted tetrazine compounds such as hydrazino tetrazines.

BACKGROUND OF THE INVENTION

Explosive decompositions of explosive compounds or mixtures are classified as either combustion or detonation. Explosives that decompose by combustion are known as deflagrating explosives or propellants, since they are often used to propel projectiles from guns. Those that detonate are known as detonating explosives, and may be divided into high or bursting explosives, blasting explosives, and priming explosives, depending upon whether they are used as bursting charges in shells or bombs, for breaking down or loosening minerals, rocks or other obstructions, or, in small quantities, in fuzes to initiate the explosion of much larger quantitites of other explosives. Explosives can be either chemical compounds (called chemical explosives) or mixtures of at least two different substances which may not themselves be explosive but form same in combination, called explosive mixtures. The oldest example of the latter is gunpowder.

Highly efficient propellants for aerospace propulsion, pyrotechnics, gas generation and the like depend upon the production of large volumes of low molecular weight gases. This has been accomplished for the most part with pyrotechnic and explosive compositions, but concerns which have received little attention are toxicity, storage stability and expense. A material which could solve many of the negative aspects of propellants commonly in use is nitrated cellulose, also known as nitrocellulose, cellulose nitrate or guncotton.

Nitrocellulose is used in great quantities in smokeless propellants for firearms, including artillery, and to some extent in combination with other propellants such as solid rocket propellants to help reduce their toxic gas production. Burning nitrocellulose generates nitrogen, carbon dioxide and water vapor, all non-toxic, low molecular weight gases. The problem is that nitrocellulose cannot be made to burn by itself rapidly enough to make it useful in most propellant applications without being mixed with other flammable or explosive materials to increase the reaction speed. Unfortunately, such additives, e.g. nitroglycerine, RDX, HMX, nitroglycol, ammonium perchlorate and the like, often create smoke and other disadvantages which the nitrocellulose was intended to overcome. Explosive and propellant compositions containing nitrocellulose in combination with other explosives are known, e.g. ballistite, composed of about 60 percent nitrocellulose and 40 percent nitroglycerine, and benite, containing about 60 parts of black powder in a matrix of about 40 parts of plasticized nitrocellulose and used as a propellant igniter.

Nitrocellulose is classified as a secondary explosive and used in many propellants. Single-base gun propellants are based primarily upon nitrocellulose, while double- and triple-base propellants contain significant quantities of additional energetic ingredients such as nitroglycerine and/or nitroguanadine. Nitrocellulose propellants are made with or without the incorporation of solvents as plasticizers by five processes—solvent extrusion, solvent emulsion, solventless extrusion, solventless rolling and casting (for rockets).

These methods can produce propellants suitable for use in various guns, rockets, and the like. The methods are described in Kirk-Othmer's 4th Ed., infra, Vol. 10, at pp. 93–100. The same reference describes the production of ball powder, a single-base or double-base nitrocellulose propellant consisting of spherically shaped or flattened ellipsoidal grains and used primarily in small arms, at pp. 100–103.

For many applications of explosives and propellants, it is desirable to adjust the burning rate of the composition. See, e.g., U.S. Pat. No. 5,295,545, issued to the University of Colorado Foundation for a "Method of Fracturing Wells Using Propellants". Considering the other properties of nitrocellulose, it would be desirable to cleanly increase its burning rate in explosive and propellant compositions. It has been reported that although the burning rate of nitrocellulose propellants at high gun pressures is not significantly affected by the presence of additives, the addition of small amounts of some metal salts to double-based propellants increases their burning rates at much lower rocket pressures. See Kirk-Othmer's *Encyclopedia of Chemical Technology*, 4th Ed., Vol. 10, p. 77 (John Wiley & Sons, NYC).

Various derivatives of 1,2,4,5-tetrazine, or s-tetrazine, are disclosed in U.S. Pat. No. 3,244,702, which is incorporated herein by reference. One such compound, 3,6-dihydrazino-1,2,4,5-tetrazine, has been reported to be useful in producing smokeless pyrotechnic compositions. Chavez & Hiskey, "High-Nitrogen Pyrotechnic Compositions," *Journal of Pyrotechnics*, Vol. 7, pp. 11–14 (Summer 1998). Kirk-Othmer's Chapter 10, supra, reports at page 54 that 3,6-dinitro-s-tetrazine has been investigated as a high energy polymeric binder for use with RDX, HMX and higher energy explosives.

SUMMARY OF THE INVENTION

It is an aspect of the present invention to produce nitrocellulose compositions having accelerated burning rates to make them suitable for various propellant and explosive applications.

Another aspect is to produce propellant and explosive compositions which are stable under storage and relatively insensitive to friction and static electricity.

Other aspects of this invention will appear from the following description and appended claims.

In accordance with the invention, compositions of nitrocellulose are provided which contain small but effective amounts of substituted s-tetrazine compounds which increase the burning rates over those of pure nitrocellulose materials or compositions based thereon. The substituted s-tetrazine compounds disclosed in U.S. Pat. No. 3,244,702 can be used as such additives, either singly or in combination. Preferably, the additive comprises a hydrazine-substituted s-tetrazine, and most preferably, comprises dihydrazino-s-tetrazine. Depending upon the proportions of nitrocellulose, other propellants and/or explosives and the proportions of the additives, the compositions are useful as gas generators, airbag propellants, rocket propellants, fuels, fireworks propellants, industrial propellants and propellants for firearms, including artillery pieces.

Before explaining the disclosed embodiments of the present invention in detail, it is to be understood that the invention is not limited in its application to the details of the particular compositions disclosed, since the invention is capable of other embodiments. Also, the terminology used herein is for the purpose of description and not of limitation.

DESCRIPTION OF THE PREFERRED EMBODIMENTS

The compositions of the present invention are based upon nitrocellulose, and the effect of the invention is for the disclosed additives to increase the burning or detonation rate of the nitrocellulose compositions. Nitrocellulose is made by treating cellulose with nitric acid, using sulfuric acid as a catalyst. These processes are well known in the art, and various forms of nitrocellulose are commercially available. The manufacture of nitrocellulose is described in Kirk-Othmer's 4th Ed., supra, in Vol. 17, pp. 68–80 ("NITRATION") and in Vol. 5, pp. 529–540 ("INORGANIC CELLULOSE ESTERS"). Both of these chapters are incorporated herein by reference. Cotton, alpha cellulose made from wood and other forms of cellulose can be used.

The cellulose repeating unit of the polymer molecule ($C_6H_{10}O_5$) contains three hydroxyl groups, all of which can unite with molecules of nitric acid, acquiring the equivalent number of nitro groups. The degree of nitration, ranging from an average of one or less nitro groups per cellulose repeating unit to the theoretical maximum of three, determines whether the nitrocellulose is suitable for making plastics, lacquers, propellants or explosives. The number of nitro groups per repeating unit is defined as the degree of substitution (DS). The maximum commercial DS is about 2.9, corresponding to about 13.8 weight percent N, but products containing over 14 weight percent N have reportedly been obtained using special processes. A stoichiometric cellulose trinitrate corresponds to 14.15 weight percent N. See "INORGANIC CELLULOSE ESTERS," supra. Kirk-Othmer's Chapter 10, supra at p. 28, reports that nitrocellulose used in propellants is most likely to have a nitrogen content of 12.6 or 13.15 weight percent, although lower grades (12.0 and 12.2% N) have also been used. Blasting gelatin uses 11–12 percent nitrogen nitrocellulose. Thus, it is postulated that the additives of the invention described below will be effective in combination with nitrocellulose containing from about 11 to about 14 weight percent N, preferably from about 12 to about 13 weight percent.

The nitrocellulose compositions to which the present invention applies are those useful as propellants and explosives. For example, the higher nitrates, or pyrocellulose, are used in making explosives. Such materials can be used in making the propellants known as guncotton, Indurite, or cordite. The nitrated cellulose is mixed with alcohol and ether, kneaded into a dough, and extruded through orifices into long multitubular strings which are cut into short cylindrical grains. Multitubular grains are used so that the exposed surface area becomes larger as the grains burn, thus increasing the pressure as burning progresses. This is an important feature for gun propellants. Various additives are used in such compositions. For example, a partially inert coolant such as potassium sulfate can be added to nitrocellulose to form flashless powder. Ballistite is a rapid-burning, double-base powder used in shotgun shells and as a rocket propellant. It is composed of about 60 percent nitrocellulose and about 40 percent nitroglycerin, and is formed into square flakes or extruded as cruciform blocks.

The nitrocellulose compositions of the present invention can be made by adding to conventional nitrocellulose compositions useful as gas generators, pyrotechnic compositions, propellants, explosives and the like an effective amount of at least one of the additives described below. By this addition, the burning or detonation rate of the composition is increased and the utility of the composition is improved and/or altered. The invention is applicable to compositions containing at least one type of nitrocellulose, preferably as the principal (majority) ingredient, together with other explosive or propellant materials or additives. Before introducing these additives into complex compositions containing nitrocellulose and other ingredients, it should be ensured that the new additives are chemically compatible with all ingredients and do not decrease stability or adversely increase sensitivity. For example, these additives are effective in various single-, double- and triple-base propellants, including both gun and rocket propellants, gas generator compositions, ballistite, benite, airbag propellants, fireworks propellants, fireworks compositions (e.g., bursting charges, theatrical pyrotechnic displays and the like) and industrial propellants.

Surprisingly, it has been found that that the addition of small but effective amounts of certain substituted S-tetrazine compounds to nitrocellulose compositions increases the burning rate substantially. For example, the addition of as little as 1 weight percent of dihydrazino-s-tetrazine to pure nitrocellulose, a "pit cotton" containing about 12.5 weight percent nitrogen from Hercules, now Alliant Tech Systems Co. and New River Energetics of Radford, Va., can increase the burning rate about 600 percent. The additives can be used in quantities ranging from those just sufficient to increase the burn or detonation rate (as little as 0.01 weight percent) up to substantial amounts, even greater than 50 weight percent. Due to the relatively high cost of the additives and diminishing returns, generally the additives are used in the minimum quantities necessary to produce the desired increase, which will generally be less than about 15 weight percent, preferably less than about 10 weight percent.

The compounds useful as such additives, and methods for their preparation, are disclosed in U. S. Pat. No. 3,244,702.

They are 3,6-substituted 1,2,4,5-tetrazines, preferably called 3,6-substituted s-tetrazines. As described in the patent, these compounds are prepared by reacting 3,6-diamino-s-tetrazine with hydrazine or other compounds. Depending upon the proportions of reactants, the product can be a uniformly di-substituted tetrazine, the monosubstituted species or a mixture of the two. Another method of preparing the preferred additive compound, 3,6-dihydrazino-s-tetrazine, is disclosed in Chavez & Hiskey's "High-Nitrogen Pyrotechnic Compositions," supra, which is incorporated herein by reference. Briefly, the preparation involves the reaction of hydrazine hydrate with 3,6-bis(3,5-dimethylpyrazol-1-yl)-1,2-dihydro-1,2,4,5-tetrazine (abbreviated BDDT) which is made from triaminoguanadine hydrochloride and 2,4-pentanedione. (See Coburn, Hiskey et al., "An Improved Synthesis of 3,6-Diamino-1,2,4,5-tetrazine From Triaminoguanadine and 2,4-Pentanedione," *Journal of Heterocyclic Chem.*, vol. 28, pp. 2049–2050, 1991.) An older method involving the hydrazinolysis of diamino-tetrazine at elevated temperatures was reported by Marcus and Remanick in "The Reaction of Hydrazine with 3,6-Diamino-s-tetrazine," *Journal of Organic Chemistry*, Vol. 28, pp. 2372–2378 (1963). Both of these articles are incorporated herein by reference.

The useful additive compounds are selected from the group consisting of those having the formula:

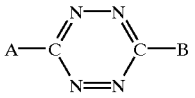

wherein A is a member selected from the group consisting of amino, hydrazino, hydrazinium strong acid salt, azido, 3-lower alkyl pyrazolone-5-yl(1), —NHN=CH—Y, —$NXNX_2$, and —$NRNR_2$; and B is a member selected from the group consisting of hydrazino, hydrazinium strong acid salts, azido, 3-lower alkyl pyrazolone-5-yl(1),-

—NHN═CH—Y, —NXNX$_2$, and —NRNR$_2$; and compounds having the formula:

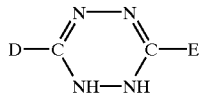

wherein D is a member selected from the group consisting of amino, hydrazino, hydrazinium strong acid salts, 3-lower alkyl pyrazolone-5-yl, —NHN═C—Y, —NHN═CH—Y.acid, —NXNX$_2$, and —NRNR$_2$; E is a member selected from the group consisting of hydrazino, hydrazinium strong acid salts, 3-lower alkyl pyrazolone-5-yl(1), —NHN═CH—Y, —NHN═CH—Y.acid, —NXNX$_2$, and —NRNR$_2$; X is selected from a group consisting of hydrogen and lower alkanoyl; Y is selected from the group consisting of hydrogen, lower alkyl, phenyl and hydroxyphenyl; R is selected from the group consisting of hydrogen, lower alkyl, phenyl, para-chlorophenyl, 2,4-dimethylphenyl, and tolyl.

Based upon initial tests, the additive preferably comprises a mono or disubstituted hydrazino s-tetrazine, the latter represented by the formula:

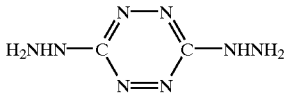

The invention is further illustrated by the following nonlimiting examples.

EXAMPLES

Commercial nitrocellulose, or "pit cotton", from Hercules, now New River Energetics of Radford, Va., containing an estimated 12.5 weight percent N was used. The material was fibrous in appearance, with an average fiber length of about 2 mm. When pressed into a paper tube of 0.5 inch diameter to a density of 1.713 g/cc, this nitrocellulose displayed a burning speed of 0.7366 mm/sec. Upon the addition of 0.04 weight percent of the accelerant 3,6-dihydrazino-s-tetrazine ($H_{z_2}T_z$) into the same nitrocellulose packed to the same density in an identical paper tube, the burning rate increased to 4.242 mm/sec, an increase of about 454 percent. Initial tests using up to about 15 weight percent of the accelerant also produced substantial observed increases in burn rate.

The effect of the accelerant upon the burn rate of strips of flash paper (containing an estimated 13 weight percent N) was to increase the burn rate by about 3 to 4 times when the paper was treated with 2 weight percent of the accelerant.

HYPOTHETICAL EXAMPLES

Quantities of the accelerant 3,6-dihydrazino-s-tetrazine or related accelerants as disclosed above ranging from about 0.1 to about 5 weight percent are added to nitrocellulose-based compositions categorized as smokeless powders, rocket propellants, airbag propellants and fireworks propellants, with the result that their burn rates are increased substantially.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A nitrocellulose composition comprising at least one nitrocellulose and an additive comprising 3,6-dihydrazino-s-tetrazine in an amount effective to increase the burning rate of the nitrocellulose composition.

2. The composition of claim 1 further comprising nitroglycerine which is formulated as a propellant composition.

3. A composition consisting essentially of nitrocellulose and an amount effective to substantially increase the burning rate of said nitrocellulose of an additive consisting essentially of a substituted s-tetrazine having at least one hydrazino substituent, said s-tetrazine being present as up to about 15 weight percent of said composition.

4. The composition of claim 3 wherein at least a portion of said substituted s-tetrazine is 3,6-dihydrazino-s-tetrazine.

5. A composition comprising as a majority ingredient nitrocellulose and an amount of an additive effective to increase the burning rate of said composition, said additive selected from the group consisting of mono- and disubstituted s-tetrazines, and mixtures thereof, wherein the substituents are selected from the group consisting of amino, azido, hydrazino and hydrazinium strong acid salts.

6. The composition of claim 3 wherein said substituted s-tetrazine is 3,6-dihydrazine-s-tetrazine.

7. The composition of claim 3 wherein said additive consists essentially of 3,6-dihydrazino-s-tetrazine.

8. The composition of claim 5 wherein said additive is present as from about 0.01 to about 15 weight percent of the composition.

9. The composition of claim 5 wherein said additive comprises a substituted s-tetrazine having at least one hydrazino substituent.

10. The composition of claim 5 wherein said additive comprises 3,6-dihydrazino-s-tetrazine.

11. The composition of claim 5 further comprising nitroglycerin which is formulated as a rocket propellant.

12. The composition of claim 5 further comprising black powder which is formulated as a fireworks propellant.

13. The composition of claim 5, further comprising at least one of nitroglycerine or nitroguanadine, which is formulated as a gun propellant.

14. The composition of claim 5 which further comprises nitroglycerine.

* * * * *

UNITED STATES PATENT AND TRADEMARK OFFICE

CERTIFICATE OF CORRECTION

PATENT NO. : 6,645,325 B1
DATED : November 11, 2003
INVENTOR(S) : Russell R. Nickel It is certified that error appears in the above-identified patent and that said Letters Patent is hereby corrected as shown below:

Title page,
Item [*] Notice, should be -- 351 -- days instead of "0" days.

Signed and Sealed this

Twenty-seventh Day of July, 2004

JON W. DUDAS
*Acting Director of the United States Patent and Trademark Office*